US010656562B2

(12) United States Patent
Sadamitsu

(10) Patent No.: US 10,656,562 B2
(45) Date of Patent: May 19, 2020

(54) IMAGE FORMING APPARATUS

(71) Applicant: CANON KABUSHIKI KAISHA, Tokyo (JP)

(72) Inventor: Yushi Sadamitsu, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/297,878

(22) Filed: Mar. 11, 2019

(65) Prior Publication Data

US 2019/0294080 A1 Sep. 26, 2019

(30) Foreign Application Priority Data

Mar. 20, 2018 (JP) ..... 2018-052363

(51) Int. Cl.

| | |
|---|---|
| ***G03G 15/09*** | (2006.01) |
| ***G03G 15/06*** | (2006.01) |
| ***G03G 15/08*** | (2006.01) |
| ***G03G 21/16*** | (2006.01) |

(52) U.S. Cl.

CPC ..... *G03G 15/0935* (2013.01); *G03G 15/065* (2013.01); *G03G 15/0865* (2013.01); *G03G 15/0881* (2013.01); *G03G 15/0889* (2013.01); *G03G 21/1647* (2013.01)

(58) Field of Classification Search

CPC ..... G03G 15/0935; G03G 15/065; G03G 15/0865; G03G 15/0881; G03G 15/0889

See application file for complete search history.

(56) References Cited

U.S. PATENT DOCUMENTS

| | | | | |
|---|---|---|---|---|
| 5,521,683 | A * | 5/1996 | Miyamoto | G03G 15/065 399/55 |
| 6,379,854 | B1 * | 4/2002 | Fujikura | G03G 9/083 430/106.1 |
| 2001/0026701 | A1 * | 10/2001 | Sasaki | G03G 15/0935 399/88 |
| 2017/0068188 | A1 | 3/2017 | Akita et al. | |

(Continued)

FOREIGN PATENT DOCUMENTS

| | | | |
|---|---|---|---|
| JP | H11-160973 | A | 6/1999 |
| JP | 2017-072753 | A | 4/2017 |

*Primary Examiner* — David M. Gray
*Assistant Examiner* — Andrew V Do
(74) *Attorney, Agent, or Firm* — Venable LLP

(57) ABSTRACT

An image forming apparatus includes an apparatus body, an image bearing member, a developing unit, a power supply, and a contact portion. The developing unit includes a developing container configured to store developer, a developer bearing member configured to rotate while bearing the developer stored in the developing container, and a developing magnet provided within the developer bearing member and comprising a plurality of magnetic poles in a circumferential direction. The developing unit is removably provided to the apparatus body. The contact portion electrically is connected with the power supply. The developing unit comprises a conductive member which is made of a conductive resin comprising a fixing portion fixing the developing magnet so that the magnetic poles of the developing magnet are fixed unrotatably with respect to the developing container. The conductive member is provided to electrically connect the contact portion with the developer bearing member.

20 Claims, 11 Drawing Sheets

(56) References Cited

U.S. PATENT DOCUMENTS

| | | | |
|---|---|---|---|
| 2018/0284641 | A1 | 10/2018 | Soeta et al. |
| 2018/0284643 | A1 | 10/2018 | Takahashi et al. |
| 2018/0284656 | A1 | 10/2018 | Takahashi et al. |

* cited by examiner

IMAGE FORMING APPARATUS

BACKGROUND OF THE INVENTION

Field of the Invention

The present invention relates to an image forming apparatus for use as a printer, a copier, a facsimile machine, or a multi-function printer adopting an electro-photographic system or an electrostatic recording system.

Description of the Related Art

An image forming apparatus adopting an electro-photographic system or an electrostatic recording system includes a developing unit to develop an electrostatic image formed on a photosensitive drum serving as an image bearing member by developer. The developing unit includes a developing sleeve serving as a developer bearing member that rotates while bearing the developer. The developing unit forms an electric field between the developing sleeve and a photosensitive drum by a developing bias applied to the developing sleeve to supply developer borne on the developing sleeve to the photosensitive drum to develop the electrostatic image. Provided within the developing sleeve is a developing magnet which is supported by the developing unit such that a phase of magnetic poles, i.e., a peripheral positions thereof, is unrotatably fixed by a metallic pole determining member.

As such developing unit, Japanese Patent Application Laid-open No. H11-160973 discloses one configured such that in order to apply a stable developing bias to the developing sleeve, a high voltage power supply is connected to a pole determining member of a developing magnet to feed the developing bias from the pole determining member to the developing sleeve. Japanese Patent Application Laid-open No. 2017-72753 also discloses another developing unit configured such that in order to cut costs, an insulating resin-made pole determining member is used instead of the metallic pole determining member and a power supply is connected with a magnet spindle by a metallic coil spring to feed power to the developing sleeve.

However, the developing unit described in Japanese Patent Application Laid-open No. H11-160973 includes a plurality of metallic members having different shapes and functions between a terminal of the power supply on a side of an apparatus body and the pole determining member in order to form a power feeding route and to position magnetic poles. The developing unit described in Japanese Patent Application Laid-open No. 2017-72753 also includes a plurality of members of different materials, shapes and functions such as resin-made parts and the metallic coil spring between a terminal of the power supply on a side of the apparatus body and the magnet spindle. Due to that, because these developing units include such a large number of parts, they have such problems as a less degree of freedom of design caused by limited disposition of the parts, inferior assemblability and high cost.

The present disclosure provides an image forming apparatus that permits to reduce a number of parts while achieving the both of positioning magnetic poles of the developing magnet and of power feeding from a power supply to a developer bearing member.

SUMMARY OF THE INVENTION

According to one aspect of the present invention, an image forming apparatus includes an apparatus body, an image bearing member, a developing unit comprising a developing container configured to store developer, a developer bearing member configured to rotate while bearing the developer stored in the developing container, and a developing magnet provided within the developer bearing member and comprising a plurality of magnetic poles in a circumferential direction, the developing unit being removably provided to the apparatus body and configured to develop an electrostatic image formed on the image bearing member, a power supply configured to apply a developing bias to the developer bearing member, and a contact portion electrically connected with the power supply. The developing unit comprises a conductive member which is made of a conductive resin comprising a fixing portion fixing the developing magnet so that the magnetic poles of the developing magnet are fixed unrotatably with respect to the developing container. The conductive member is provided to electrically connect the contact portion with the developer bearing member.

Further features of the present invention will become apparent from the following description of exemplary embodiments with reference to the attached drawings.

DESCRIPTION OF THE EMBODIMENTS

First Embodiment

Figure 1:
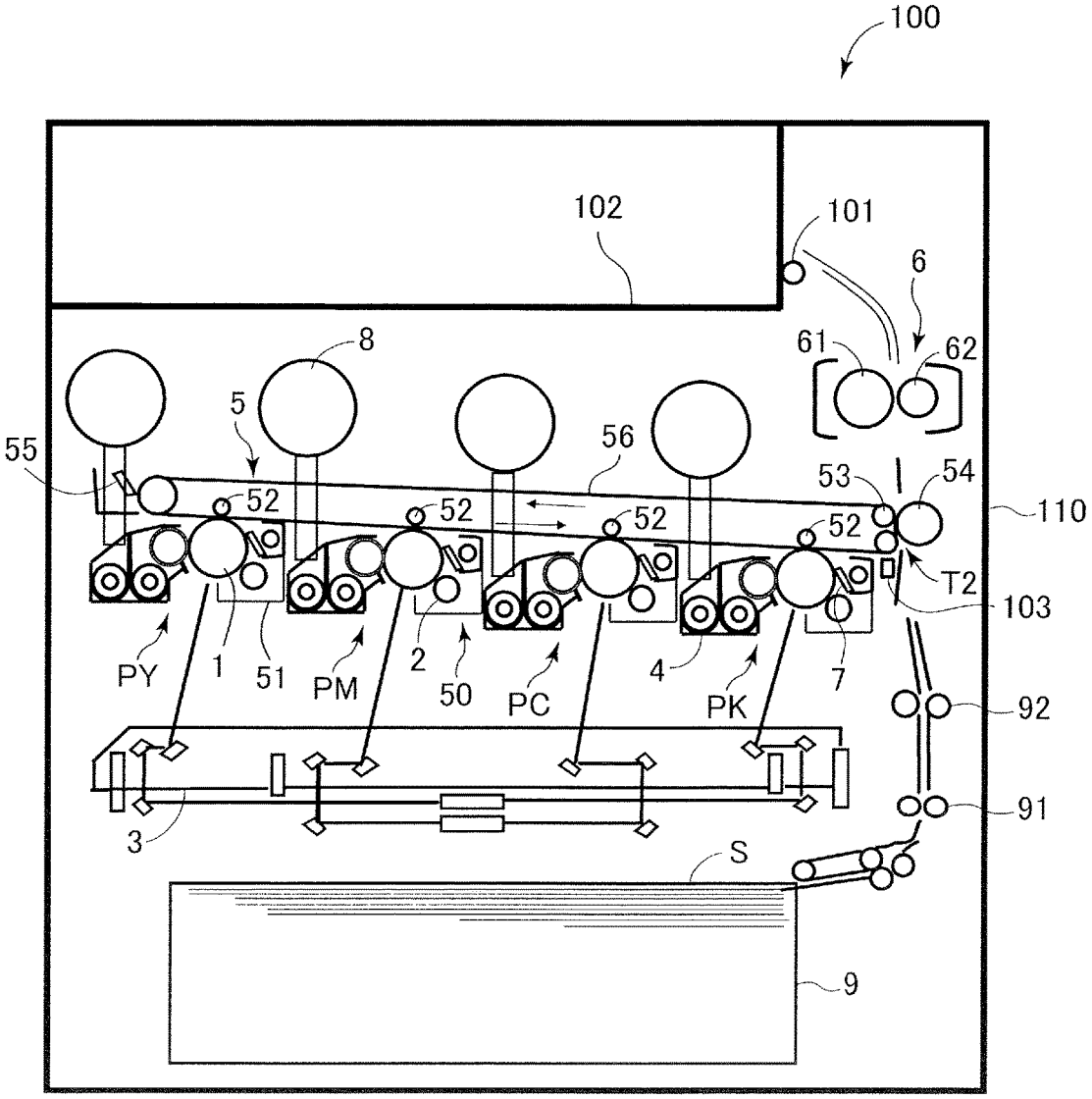
FIG. 1 is a schematic section view illustrating a configuration of an image forming apparatus of a first embodiment.

A first embodiment of the present disclosure will be described below in detail with reference to FIGS. 1 through 9. At first, a schematic configuration of an image forming apparatus of the first embodiment will be described with reference to FIG. 1.

Image Forming Apparatus

The image forming apparatus 100 of the present embodiment is an electro-photographic tandem-type full-color printer including four image forming portions PY, PM, PC and PK each having a photosensitive drum 1 serving as an image bearing member. The image forming apparatus 100 forms a toner image on a recording material corresponding to an image signal transmitted from a document reading apparatus not illustrated or a host device such as a personal computer communicably connected with an apparatus body 110. The recording material is a sheet member (abbreviated as a "sheet" hereinafter) such as a sheet of paper, a plastic film and a cloth. The image forming portions PY, PM, PC and PK form toner images of yellow, magenta, cyan and black, respectively.

Note that the four image forming portions PY, PM, PC and PK of the image forming apparatus 100 have the same configuration except that their developing colors are different. Accordingly, the description of the configuration will be made typically only on the image forming portion PY below while omitting the description on the other image forming portions.

The image forming portion PY includes the photosensitive drum 1, a charging roller 2, an exposing unit (laser scanner in the present embodiment) 3, a developing unit 4, a primary transfer roller 52 and a cleaning blade 7. The photosensitive drum 1 and the charging roller 2 are rotatably supported by a drum container 51, and the charging roller 2 and the cleaning blade 7 are supported in a condition of being pressed against the photosensitive drum 1. The photosensitive drum 1, the charging roller 2, the cleaning blade 7 and the drum container 51 compose a drum cartridge 50 which is attachable to/detachable from the apparatus body 110. The photosensitive drum 1 is drivably connected with a driving source, not illustrated and built in the apparatus body 110, and rotates by a driving force of the driving source. Because the charging roller 2 is pressed against the photosensitive drum 1, the charging roller 2 rotates following the photosensitive drum 1. Because the photosensitive drum 1, the charging roller 2 and the cleaning blade 7 deteriorate through image forming processes and the drum cartridge 50 needs to be replaced corresponding to an amount of prints, the drum cartridge 50 is configured to be attachable to/detachable from the apparatus body 110. Note that each of the image forming portions PY, PM, PC and PK of the apparatus body 110 is provided with a guide rail 111 serving as an attachment portion to attachably/detachably mount the developing unit 4 (see FIGS. 5A through 6B).

Disposed above the respective image forming portions PY, PM, PC and PK is a transfer unit 5. The transfer unit 5 is configured such that an endless intermediate transfer belt 56 is stretched around a plurality of rollers so as to circularly move (rotate) in a direction of arrows. The intermediate transfer belt 56 transfers while bearing a toner image primarily transferred onto the intermediate transfer belt 56. A secondary transfer outer roller 54 is disposed at a position facing a secondary transfer inner roller 53 among the rollers stretching the intermediate transfer belt 56 such that the intermediate transfer belt 56 is nipped between the secondary transfer outer roller 54 and the secondary transfer inner roller 53, and composes a secondary transfer portion T2 where the toner image on the intermediate transfer belt 56 is transferred onto a sheet S. Disposed downstream in a sheet conveyance direction of the secondary transfer portion T2 is a fixing unit 6. Storage containers 8 for replenishing developers to be replenished to the developing unit 4 are disposed above the transfer unit 5.

A cassette 9 storing the sheet S is disposed at a lower part of the image forming apparatus 100. The sheet S fed from the cassette 9 is conveyed by a conveyance roller 91 toward a registration roller 92. The registration roller 92 in a halt condition corrects a skew of the sheet S by forming a loop by abutting with a leading edge of the sheet S. After that, the registration roller 92 is started to rotate in synchronism with the toner image on the intermediate transfer belt 56 to convey the sheet S to the secondary transfer portion T2.

A process of forming a four-color image for example by the image forming apparatus 100 constructed as described above will be described below. At first, when an image forming operation is started, a surface of the rotating photosensitive drum 1 is homogeneously charged by the charging roller 2. Next, the photosensitive drum 1 is exposed by a laser beam corresponding to an image signal emitted from the exposing unit 3. Thereby, an electrostatic image corresponding to the image signal is formed on the photosensitive drum 1. The electrostatic image on the photosensitive drum 1 is developed and is visualized by toner serving as the developer stored within the developing unit 4.

Figure 2:
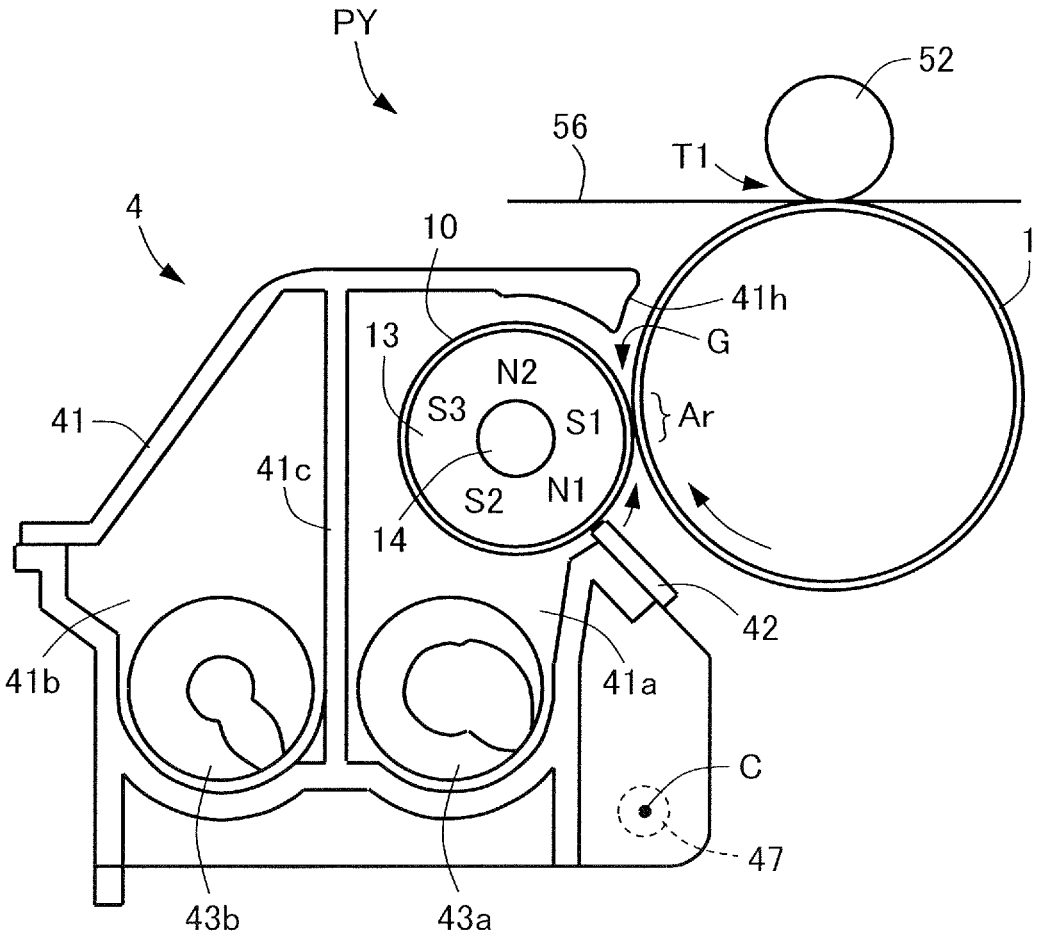
FIG. 2 is a schematic section view illustrating a developing unit of the first embodiment.

The toner image formed on the photosensitive drum 1 is primarily transferred onto the intermediate transfer belt 56 at a primary transfer portion T1 between the photosensitive drum 1 and a primary transfer roller 52 disposed at a position facing the photosensitive drum 1 with the intermediate transfer belt 56 therebetween (see FIG. 2). At this time, a primary transfer bias is applied to the primary transfer roller 52. After the primary transfer, transfer residual toner left on the surface of the photosensitive drum 1 is removed by the cleaning blade 7.

Such operations are sequentially performed in the respective image forming portions of yellow, magenta, cyan and black, and the four toner images are superimposed on the intermediate transfer belt 56. After that, the sheet S stored in the cassette 9 is conveyed to the secondary transfer portion T2 in synchronism with the toner image forming timing. Then, a secondary transfer bias is applied to the secondary transfer outer roller 54 to secondarily transfer the four color toner images on the intermediate transfer belt 56 collectively onto the sheet S. The toner left on the intermediate transfer belt 56 without being transferred at the secondary transfer portion T2 is removed by an intermediate transfer belt cleaner 55.

Next, the sheet S is conveyed to the fixing unit 6. The fixing unit 6 includes a fixing roller 61 having a heat source such as a halogen heater therein and a pressure roller 62 and has a fixing nip portion formed between the fixing roller 61 and the pressure roller 62. The sheet S onto which the toner image has been transferred is passed through the fixing nip portion of the fixing unit 6 such that the sheet S is applied with heat and pressure. Then, the toner on the sheet S is melted and is mixed and is fixed on the sheet S as a full-color image. After that, the sheet S is discharged by a discharge roller 101 onto a discharge tray 102. Thereby, the series of image forming processes is finished.

It is noted that the image forming apparatus 100 of the present embodiment is capable of forming a monochromatic image, e.g., a black monochromatic image, or a multicolor image by using a desirable monochromatic image forming portion or some color image forming portions among the four color image forming portions.

Developing Unit

Next, a detailed configuration of the developing unit 4 will be described below with reference to FIGS. 2 through 4. In the present embodiment, the developing unit 4 is formed into a cartridge as a developing cartridge. The developing unit 4 is removably attached to the guide rail 111 of the apparatus body 110 (see FIGS. 5A through 6B). The developing unit 4 includes a developing container 41 configured to store developer containing non-magnetic toner and magnetic carrier and a developing sleeve 10 which is a cylindrical rotary member serving as a developer bearing member that rotates while bearing the developer within the developing container 41. The developing sleeve 10 is stored within the developing container 41 while leaving a gap G between the photosensitive drum 1, bears the developer within the developing container 41, and can develop the electrostatic image by conveying the developer to a counter area (developing area) Ar of the photosensitive drum 1 facing the developing sleeve 10. It is noted that the developing container 41 is made of an insulating resin.

Figure 3:
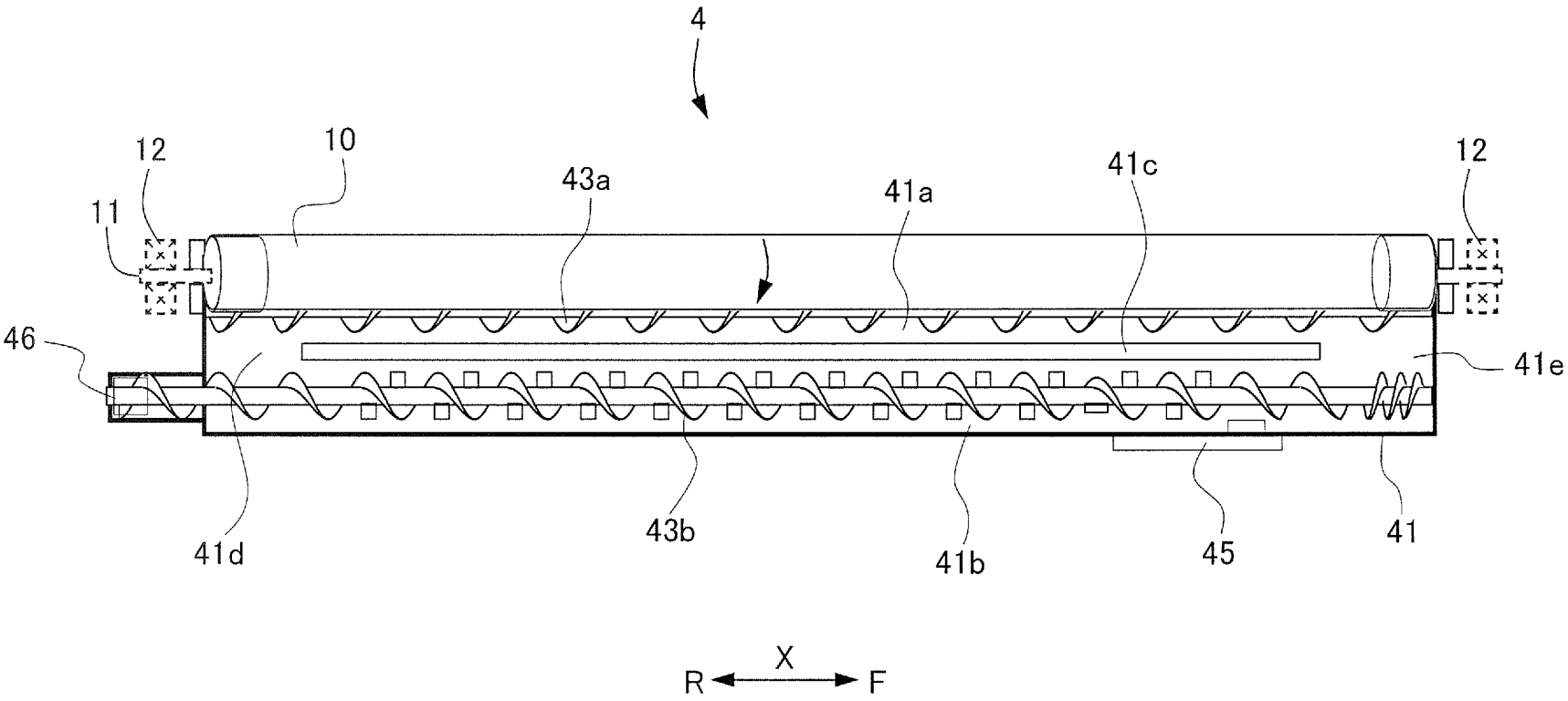
FIG. 3 is a longitudinal section view illustrating the developing unit of the first embodiment.

As illustrated in FIG. 3, the developing sleeve 10 includes a conductive center shaft 11, is supported by a sleeve bearing 12 that supports the center shaft 11 rotatably with respect to the developing container 41 and is rotationally driven in a direction of an arrow in FIG. 2. The sleeve bearing 12 is provided in the developing unit 4 (see FIG. 9). Note that a rotational axial direction of the developing sleeve 10 will be denoted as a longitudinal direction (width direction) X in the present embodiment. Still further, a front side of the apparatus body 110 in the longitudinal direction X will be denoted as a front direction F and a back side as a rear direction R. One end portion corresponds to an end portion on the side of the front direction F and another end portion corresponds to an end portion on the side of the rear direction R.

As illustrated in FIG. 2, disposed unrotatably with respect to the developing container 41 within the developing sleeve 10 is a magnet roller 13 serving as a developing magnet having a plurality of magnetic poles arrayed in a circumferential direction. The magnet roller 13 is supported by a conductive magnet spindle 14 serving as a spindle with respect to the developing container 41 (see FIG. 9). That is, the magnet spindle 14 supports the magnet roller 13 while fixing the magnet roller 13 unrotatably. An inside of the developing container 41 is divided approximately at a center portion thereof laterally into a developing chamber 41*a* and an agitating chamber 41*b* by a partition wall 41*c* that extends in the rotational axial direction. The developer is stored in the developing chamber 41*a* and the agitating chamber 41*b*. Conveyance screws 43*a* and 43*b* serving as agitating members for circulating, while agitating and conveying, the developer within the developing container 41 are disposed respectively in the developing and agitating chambers 41*a* and 41*b*. Provided at both ends in the longitudinal direction X of the partition wall 41*c*, (left and right sides in FIG. 3) are communicating portions 41*d* and 41*e* that permit the developer to pass between the developing chamber 41*a* and the agitating chamber 41*b*.

The conveyance screws 43*a* and 43*b* are formed with spiral blades respectively around a rotational shaft thereof. The conveyance screw 43*a* is disposed at a bottom of the developing chamber 41*a* along the longitudinal direction X of the developing sleeve 10. Then, the conveyance screw 43*a* supplies the developer to the developing sleeve 10 while conveying the developer within the developing chamber 41*a* in the rotational axial direction as a rotational shaft thereof is rotated by a driving source 117 (see FIG. 8). The developer borne by the developing sleeve 10 and from which the toner has been consumed during the developing step is collected in the developing chamber 41*a*. The conveyance screw 43*b* is also disposed at a bottom of the agitating chamber 41*b* along the longitudinal direction X of the developing sleeve 10 and conveys the developer within the agitating chamber 41*b* in a rotational axial direction opposite to the developer conveyance direction of the conveyance screw 43*a*. The developer is thus conveyed by the conveyance screws 43*a* and 43*b* and circulates within the developing container 41 through the communicating portion 41*d* in the rear direction R and the communicating portion 41*e* in the front direction F.

A developer replenishing port 46 configured to replenish the developer, containing the toner, into the developing container 41 is provided at an upstream end in the developer conveyance direction of the conveyance screw 43*b* in the agitating chamber 41*b*. The developer replenishing port 46 is connected with a replenishing conveyance portion 83 of a developer replenishing apparatus 80 as illustrated in FIG. 4. Accordingly, the developer being replenished is supplied into the agitating chamber 41*b* from a developer replenishing apparatus 80 through the replenishing conveyance portion 83 and the developer replenishing port 46. The conveyance screw 43*b* homogenizes toner concentration by conveying the developer while agitating the developer replenished from the developer replenishing port 46 and developer existing already within the agitating chamber 41*b*.

Accordingly, as illustrated in FIG. 3, the developer within the developing chamber 41*a* from which toner has been consumed in the developing step and whose toner concentration is lowered is moved into the agitating chamber 41*b* through the communicating portion 41*d* in the rear direction R (on the left side in FIG. 3) by a conveyance force of the conveyance screws 43*a* and 43*b*. Then, the developer moved into the agitating chamber 41*b* is conveyed while being agitated with replenished developer and is moved to the developing chamber 41*a* through the communicating portion 41*e* in the front direction F (on the right side in FIG. 3).

As illustrated in FIG. 2, the developing chamber 41*a* of the developing container 41 is provided with an opening portion 41*h* at a position corresponding to a counter area Ar facing the photosensitive drum 1, and the developing sleeve 10 is rotatably disposed such that a part thereof is exposed in a direction of the photosensitive drum 1 through the opening portion 41*h*. The developing sleeve 10 constructed as described above is rotationally driven by the driving source 117 (see FIG. 8), can convey the developer to the counter area Ar and supplies the developer to the photosensitive drum 1 in the counter area Ar. The developing sleeve 10 is formed into a cylindrical shape by a nonmagnetic material such as aluminum and stainless steel in the present embodiment. The developing sleeve 10 rotates upward from downward in terms of the gravity direction in the counter area Ar, i.e., counterclockwise in FIG. 2.

Fixed upstream in the rotational direction of the developing sleeve 10 of the developing container 41*h* is a developing blade 42 that regulates an amount (layer thickness) of the developer borne on the developing sleeve 10. That is, the developing blade 42 forms a thin layer of the developer on a surface of the developing sleeve 10. Because the developing sleeve 10 rotates upward from downward in terms of the gravity direction in the counter area Ar, the developing blade 42 is positioned downward in terms of the gravity direction in the counter area Ar in the present embodiment.

The magnet roller 13 is formed into a roller while having a plurality of magnetic poles S1, S2, S3, N1 and N2, i.e., five poles in total, in a circumferential direction thereof as illustrated in FIG. 2. The magnet roller 13 configured as described above generates a magnetic field bearing the developer on the developing sleeve 10 and a magnetic field that peels the developer off from the developing sleeve 10 in a peeling region.

As the developing sleeve 10 rotates, the developer on the developing sleeve 10 bristles at the regulating magnetic pole N1, and a layer thickness of the developer is regulated by the developing blade 42 facing the regulating magnetic pole N1. Then the developer whose layer thickness has been regulated is conveyed to the counter area Ar facing the photosensitive drum 1 and forms a magnetic brush by being bristled at the developing magnetic pole S1. The magnetic brush comes into contact with the photosensitive drum 1 that rotates in the same direction with the developing sleeve 10 in the counter area Ar, and the electrostatic latent image is developed as a toner image by the charged toner.

After that, the developer on the developing sleeve 10 is conveyed into the developing container 41 as the developing sleeve 10 rotates while keeping the attraction of the developer on the surface of the developing sleeve 10 by the conveyance magnetic pole N2. Then, the developer borne on the developing sleeve 10 is peeled off the surface of the developing sleeve 10 in the peeling region formed by the homopolar peeling magnetic pole S3 and the attracting magnetic pole S2 disposed sequentially in the rotation direction of the developing sleeve 10. The peeled developer is collected in the developing chamber 41*a* of the developing container 41.

Figure 5A:
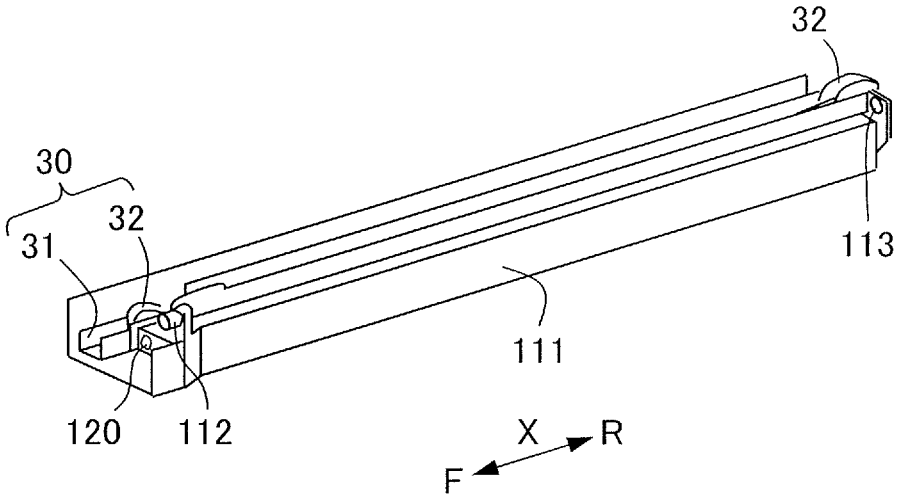
FIG. 5A is a perspective view illustrating a guide rail of the first embodiment in a condition before when the developing unit is mounted to the guide rail.
Figure 5B:
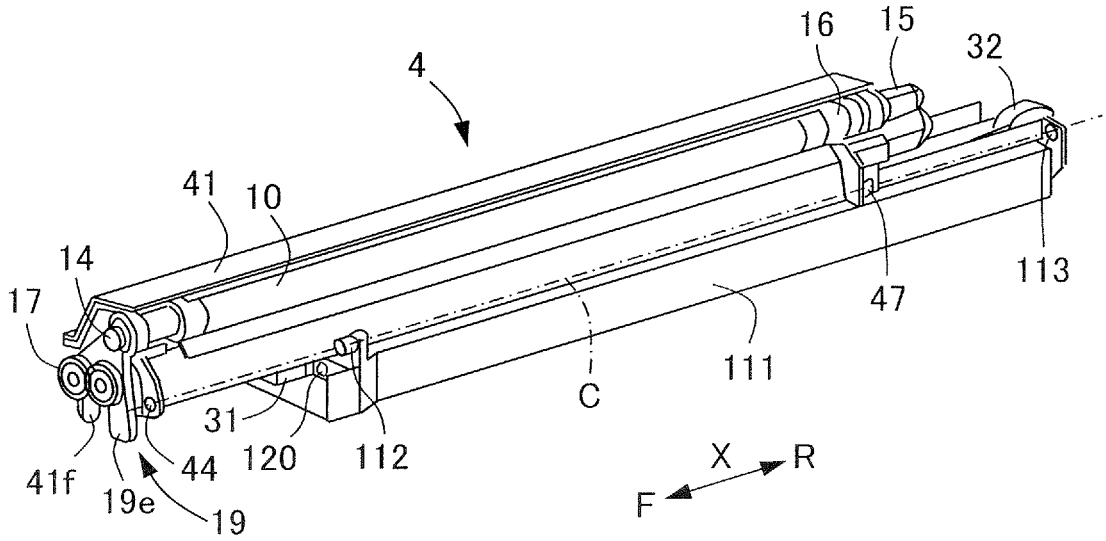
FIG. 5B is a perspective view illustrating the guide rail of the first embodiment in a condition in which the developing unit is on a way of being mounted to the guide rail.

It is noted that the developing container 41 is provided with an inductance sensor 45 serving as a toner concentration sensor for detecting toner concentration within the developing container 41 as illustrated in FIG. 3. In the present embodiment, the inductance sensor 45 is provided downstream in the developer conveyance direction of the agitating chamber 41*b*. Still further, as illustrated in FIG. 2, provided under the developing sleeve 10 on the side of the rear direction R of the developing container 41 is a center shaft 47 whose axial direction is the longitudinal direction X and whose end part in the rear direction R is free end (see also FIG. 5B). Still further, as illustrated in FIG. 5B, an engage hole 44 penetrating through in the longitudinal direction X is defined under the developing sleeve 10 on the side of the front direction F of the developing container 41. The center shaft 47 and the engage hole 44 are disposed on a same center line C whose axial direction is the longitudinal direction X. The center shaft 47 and the engage hole 44 will be described later in detail.

Developer Replenishing Apparatus

Figure 4:
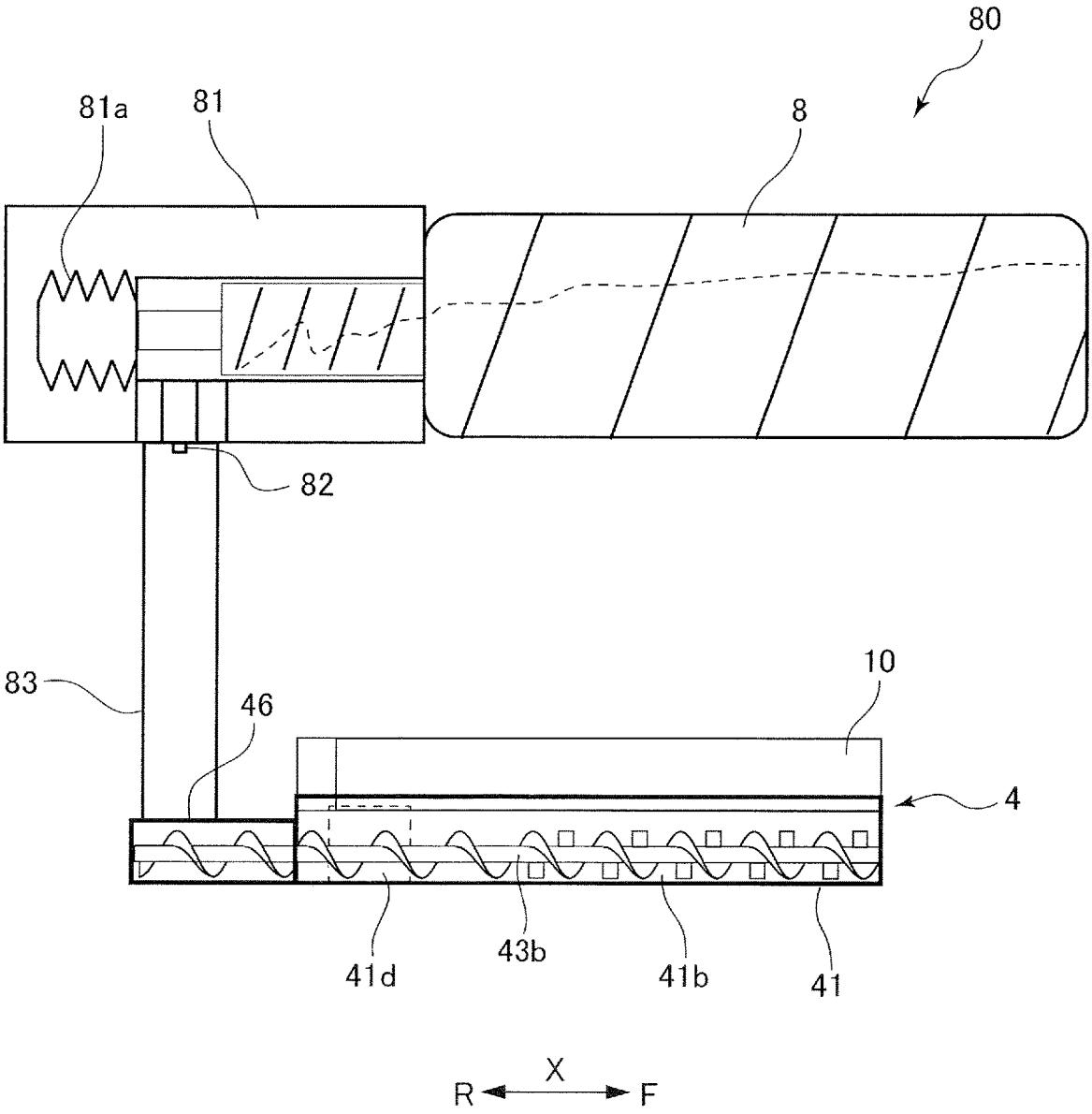
FIG. 4 is a section view of a developer replenishing apparatus and the developing unit of the first embodiment.

As illustrated in FIG. 4, the developer replenishing apparatus 80 includes a storage container 8 configured to store the developer to be replenished, a replenishing mechanism 81 and a replenishing conveyance portion 83. The storage container 8 is configured such that a spiral groove is cut on an inner wall of the cylindrical container and generates a conveyance force for conveying the developer in a longitudinal direction X as the storage container 8 rotates by itself. A downstream end in a developer conveyance direction of the storage container 8 is connected with the replenishing mechanism 81. The replenishing mechanism 81 includes a pump portion 81*a* that discharges the developer conveyed from the storage container 8 through a discharge port 82. The pump portion 81*a* is formed into a bellow shape, generates air pressure by changing its capacity by being rotationally driven and discharges the developer conveyed from the storage container 8 through the discharge port 82. An upper end portion of the replenishing conveyance portion 83 is connected with the discharge port 82 and a lower end portion of the replenishing conveyance portion 83 is connected with the developer replenishing port 46 of the developing apparatus 4. The developer discharged out of the discharge port 82 by the pump 81*a* is replenished into the developing container 41 of the developing unit 4 through the replenishing conveyance portion 83.

A replenishing operation of the developer replenishing apparatus 80 constructed as described above is performed by automatic toner replenisher (ATR) control. The ATR control is what replenishes the developer to the developing apparatus 4 by controlling operations of the developer replenishing apparatus 80 in accordance with an image ratio in forming an image, the inductance sensor 45 and a detection result of concentration of a patch image detected by a concentration sensor 103 (see FIG. 1) that detects concentration of a toner image.

As illustrated in FIG. 1, the concentration sensor 103 is disposed so as to face the surface of the intermediate transfer belt 56 downstream of the image forming portion PK and upstream of the secondary transfer portion T2 in the rotational direction of the intermediate transfer belt 56. In a control using the concentration sensor 103, a control toner image, i.e., a patch image, is transferred onto the intermediate transfer belt 56 with timing in starting an image forming job or in every time in forming images of a predetermined number of sheets to detect concentration of the patch image by the concentration sensor 103. Then, based on the detection result, the developer replenishing apparatus 80 is controlled to replenish the developer. Note that the configuration for replenishing the developer to the developing unit 4 is not limited to be that described above and may be a conventionally known configuration.

Configuration for Inserting/Drawing Developing Unit

A configuration for inserting/drawing the developing unit 4 into/out of the apparatus body 110 will be described with reference to FIGS. 5A through 7B. At first, as illustrated in FIG. 5A, the guide rail 111 of the apparatus body 110 is provided with a pressing mechanism 30 that can press the developing unit 4 against the drum cartridge 50, a center shaft 112 provided on the side of the front direction F and an engage hole 113 provided on the side of the rear direction R. As illustrated in FIG. 7B, the pressing mechanism 30 includes an operating member 31 provided along the longitudinal direction X, a pressing member 32 provided in near both ends in the longitudinal direction X of the operating member 31 and an urging spring 33 urging each pressing member 32 upward. The operating member 31 is movable in the longitudinal direction X and is linked with the pressing member 32 in the longitudinal direction X. Due to that, as the operating member 31 is drawn out to the side of the front direction F, the pressing member 32 is also drawn out by a same amount. The pressing member 32 is drawn out to the side of the front direction F by the operating member 31 and can press the developing unit 4 to the drum cartridge 50 by pressing a supporting portion 41*f* of the developing unit 4 described later upward in positioning the supporting portion 41*f* of the developing unit 4 above the pressing member 32. The urging spring 33 is made of a compression spring for example and is provided between the operating member 31 and the pressing member 32 to urge the pressing member 32 upward with respect to the operating member 31.

As illustrated in FIG. 5B, the center shaft 112 and the engage hole 113 are disposed on the same center line C with an axial line in the longitudinal direction X. Still further, the engage hole 44 and the center shaft 47 provided in the developing unit 4 are disposed on the same center line C with the center shaft 112 and the engage hole 113. That is, the engage hole 44 and the center shaft 47 are engageable with each other and their axial line becomes the center line C of rotation in pressing the developing unit 4 against the drum cartridge 50. The center shaft 112 is disposed on the side of the front direction F of the guide rail 111 and an end part thereof in the front direction F is provided as a free end. Meanwhile, as illustrated in FIG. 7B, the supporting portion 41*f* projecting downward is provided at a lower part of the developing unit 4 opposite from the photosensitive drum 1. As a lower end surface of the supporting portion 41*f* abuts with and is pushed up by an upper surface of the pressing member 32, the developing unit 4 turns centering on the center shaft 112 and the engage hole 113 as described later and is pressed to the drum cartridge 50. Note that the supporting portions 41*f* are provided at two places of an end on the side of the front direction F of the developing unit 4 and another end on the side of the rear direction R. Then, the supporting portion 41*f* on the side of the front direction F of the developing unit 4 is provided in a fixing conductive member 19 described later, and the supporting portion 41*f* on the side of the rear direction R is provided in the developing container 41.

The developing unit 4 is attached to/detached from the apparatus body 110 by inserting into/drawing out of the apparatus body 110 in the longitudinal direction X. In the present embodiment, an upstream side in an insert direction of inserting the developing unit 4 into the apparatus body 110 is the front direction F, and a downstream side in the insert direction of the developing unit 4 is the rear direction R. As illustrated in FIG. 5B, the developing unit 4 is inserted into the guide rail 111 while sliding in the rear direction R. At this time, the pressing member 32 is provided at a lower position without being pushed up by the operating member 31, and the supporting portion 41*f* of the developing unit 4 is inserted without abutting with the pressing member 32.

Figure 6A:
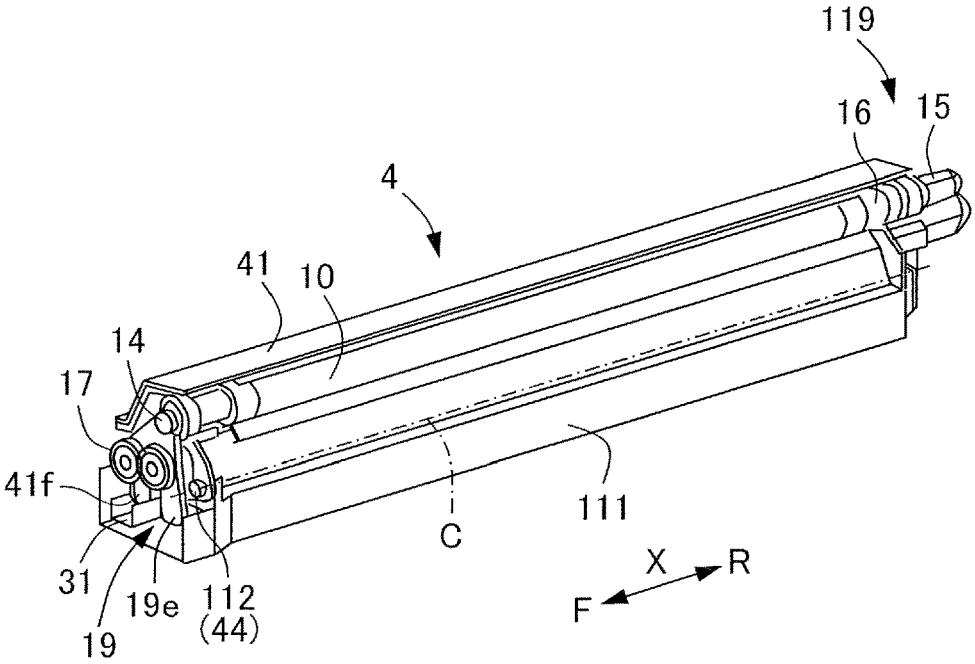
FIG. 6A is a perspective view illustrating the guide rail of the first embodiment in a condition in which the developing unit is inserted into a rear side of the guide rail.

Then, as illustrated in FIG. 6A, the developing unit 4 is inserted into a deepest part on the side of the rear direction R of the guide rail 111. At this time, the engage hole 44 of the developing container 41 engages with the center shaft 112 of the guide rail 111 on the side of the front direction F of the guide rail 111, and the center shaft 47 of the developing container 41 engages with the engage hole 113 of the guide rail 111, thus becoming a rotational center line on the side of the rear direction R of the guide rail 111. The developing unit 4 becomes turnable toward the photosensitive drum 1 centering on this rotational center line. However, as illustrated in FIG. 7A, the developing sleeve 10 is separated from the photosensitive drum 1 widely in the facing direction at this time and no gap G of a predetermined distance is formed between the developing sleeve 10 and the photosensitive drum 1.

Figure 6B:
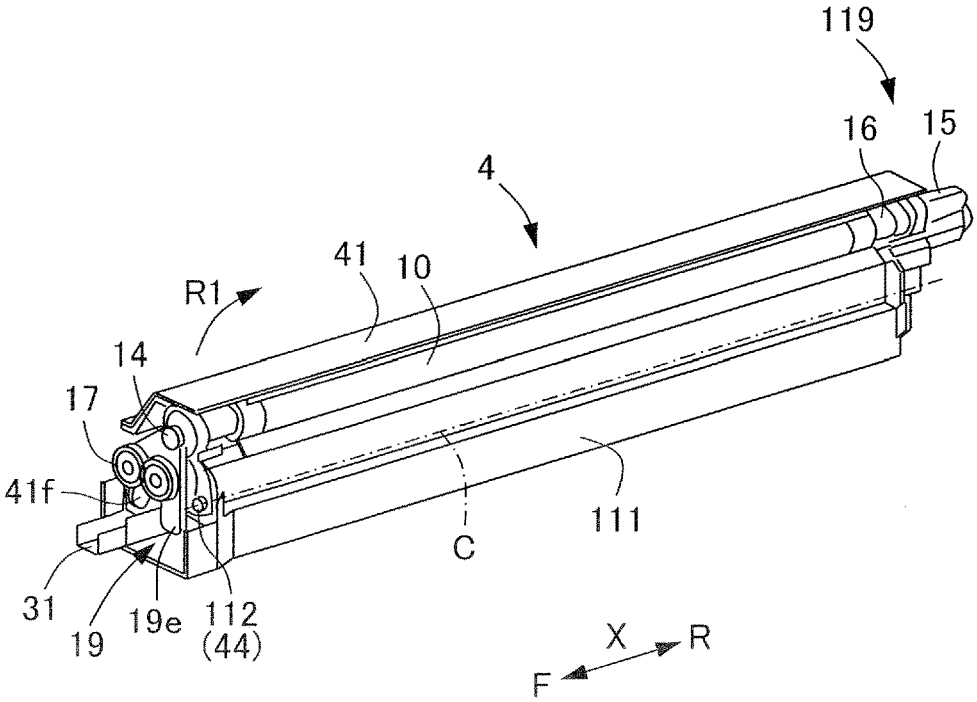
FIG. 6B is a perspective view illustrating the guide rail of the first embodiment in a condition in which the developing unit is pressed against a drum cartridge.

Then, as the operating member 31 is drawn to the side of the front direction F as illustrated in FIG. 6B, the pressing member 32 is drawn to the side of the front direction F and enters right under the supporting portion 41*f* of the developing unit 4. At this time, as illustrated in FIG. 7B, the pressing member 32 presses the supporting portion 41*f* upward by the urging force of the urging spring 33 and presses the developing unit 4 toward the drum cartridge 50. Here, the pressing member 32 abuts with the supporting portion 41*f* of the fixing conductive member 19 toward an upper direction U as a cross direction crossing with the longitudinal direction X. The urging spring 33 urges the pressing member 32 in the upper direction U and also urges the developing unit 4 toward the photosensitive drum 1 through the fixing conductive member 19. Due to that, the developing unit 4 is urged in a rotational direction R1 centering on the center line C. Thereby, the developing unit 4 and the drum cartridge 50 can be positioned such that parts of the container for example abut with each other in the facing direction, and the gap G of the predetermined distance is defined between the developing sleeve 10 and the photosensitive drum 1 facing with each other in the counter area Ar. The developing unit 4 and the drum cartridge 50 abut with each other such the distance of the gap G becomes 300±30 μm for example.

Figure 7A:
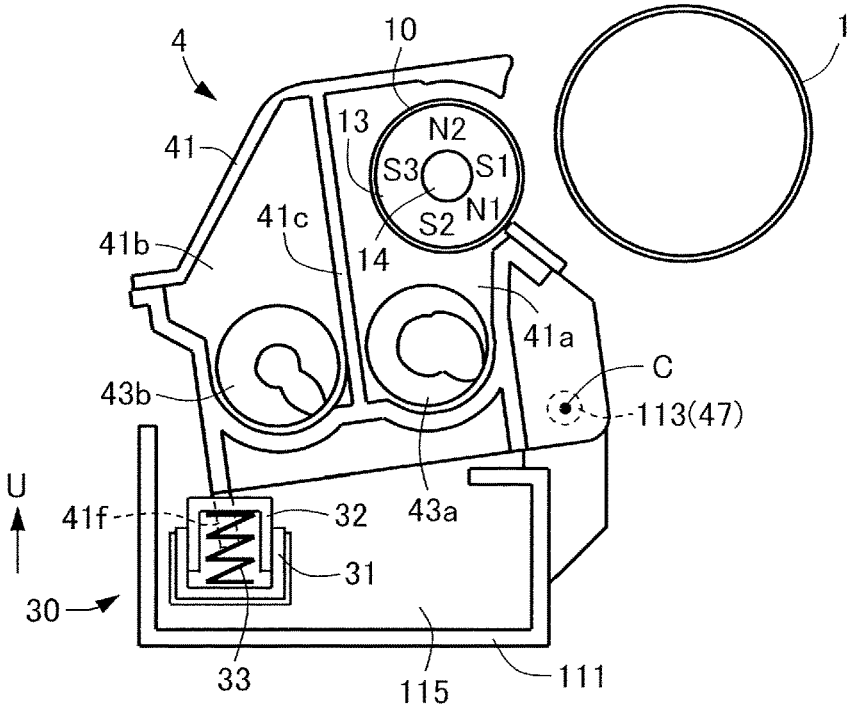
FIG. 7A is a section view illustrating the developing unit and the guide rail of the first embodiment in a condition in which the developing sleeve of the developing unit is largely separated from a photosensitive drum.
Figure 7B:
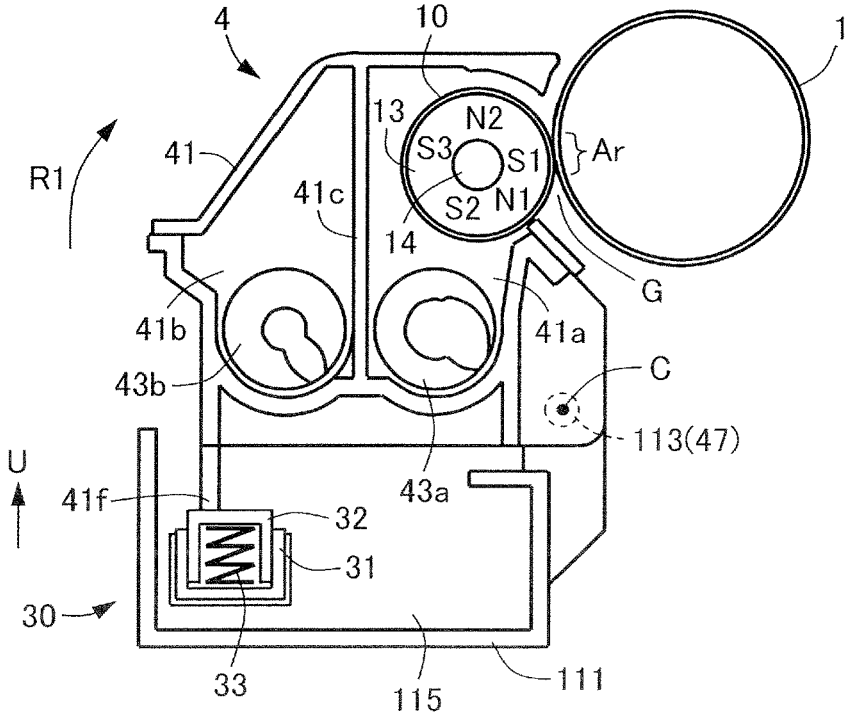
FIG. 7B is a section view illustrating the developing unit and the guide rail of the first embodiment in a condition in which the photosensitive drum and the developing sleeve of the developing unit have a gap of a predetermined distance.

As illustrated in FIGS. 7A and 7B, the guide rail 111 is formed approximately into a shape of a channel in section whose upper part is opened, and the developing unit 4 is disposed on the opened upper part. Then, a space between the guide rail 111 and the developing unit 4 is utilized as a ventiduct 115 communicating both ends in the longitudinal direction X of the guide rail 111. That is, the developing unit 4 is attached to the guide rail 111 so as to have the ventiduct 115 through which air flows along the longitudinal direction X. Thus, the ventiduct 115 is defined by a lower surface of the developing container 41 and the guide rail 111, and the developing unit 4 is cooled by suctioning air from a fan not illustrated and installed on the side of the front direction F of the apparatus body 110 and by ventilating air toward the rear direction R side.

Driving System of Developing Unit

As illustrated in FIG. 5B, the developing sleeve 10 is provided with a first coupling 15 at the end of the rear direction R side. When the developing unit 4 is attached to the guide rail 111, the first coupling 15 engages with a second coupling 116 (see FIG. 8) provided in the apparatus body 110. The second coupling 116 is linked with the driving source 117 such as a motor (see FIG. 8). That is, the first and second couplings 15 and 116 constitute a coupling portion 119 drivably connecting the developing sleeve 10 with the driving source 117. The coupling portion 119 is disposed in the vicinity of the end on the side of the rear direction R of the longitudinal direction X of the developing unit 4. The developing sleeve 10 is rotated by rotational drive of the driving source 117 through the couplings 116 and 15. The rotation of the developing sleeve 10 is transmitted to the conveyance screw 43*a* through a gear train 16. The rotation of the conveyance screw 43*a* is also transmitted to the conveyance screw 43*b* by a gear train 17 provided on the side of the front direction F of the developing unit 4. According to the present embodiment, it is possible to suppress friction and temperature rise otherwise generated in sliding parts of the developing sleeve 10 and the respective conveyance screws 43*a* and 43*b* by disposing the developing sleeve 10 whose load torque is large in upstream of the driving train.

Control Portion

Figure 8:
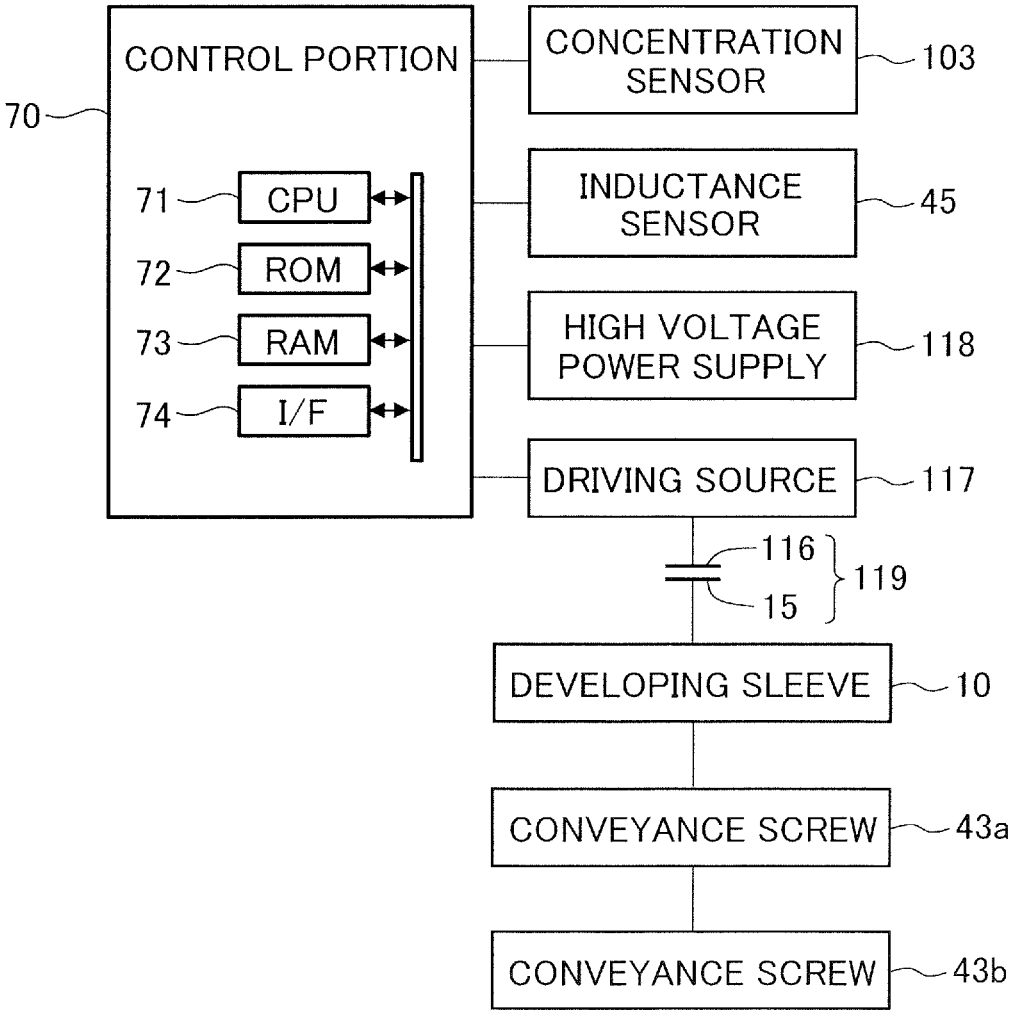
FIG. 8 is a control block diagram of the image forming apparatus of the first embodiment.

As illustrated in FIG. 8, a control portion 70 is composed of a computer and includes a CPU 71, a ROM 72 storing a program controlling each portion, a RAM 73 temporarily storing data and an input/output circuit (I/F) 74 inputting/outputting a signal from/to an external device. The CPU 71 is a microprocessor controlling an entire control of the image forming apparatus 100 and is a main body of a system controller. The CPU 71 is connected with the sheet feeding portion, the image forming portion, the sheet conveying portion and others through the input/output circuit 74 to exchange signals with and to control operations of the respective portions. The control portion 70 is connected with the concentration sensor 103, the inductance sensor 45, the driving source 117 of the developing unit 4, a high voltage power supply 118 feeding the developing bias and others and can control the driving source 117 and others based on detection results of the respective sensors.

Fixing Conducting Member

Figure 9:
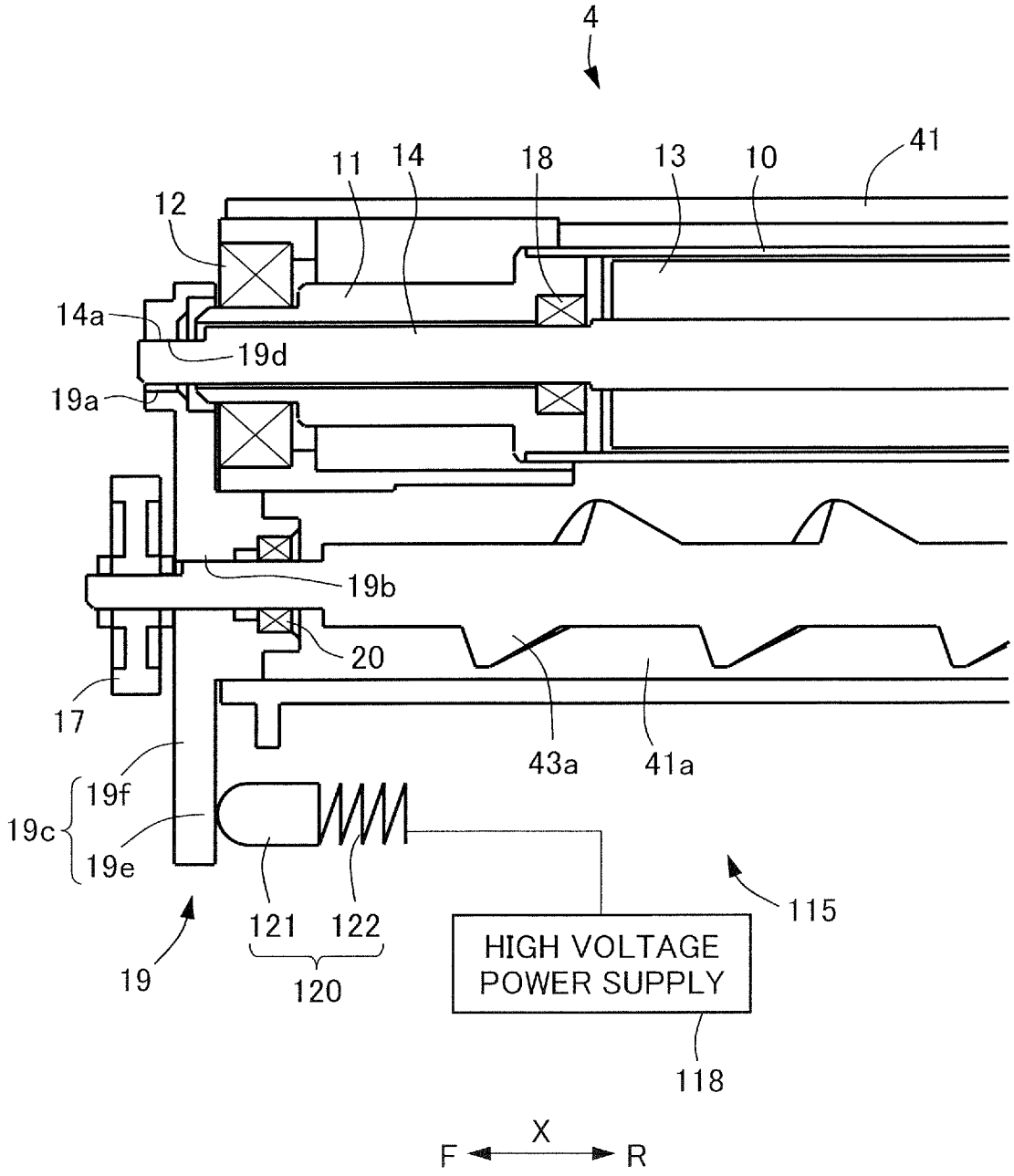
FIG. 9 is an enlarged longitudinal section view illustrating a front side end of the developing unit of the first embodiment.

As illustrated in FIG. 9, the developing container 41 supports the center shaft 11 rotatably through the sleeve bearing 12. The center shaft 11 is formed into a shape of a sleeve and supports the magnet spindle 14 therein relatively rotatably through a conductive bearing 18. That is, the bearing 18 makes the magnet spindle 14 and the developing sleeve 10 relatively rotatable. Note that the magnet spindle 14 is supported by the fixing conductive member 19 described later unrotatably with respect to the developing container 41. The magnet spindle 14 is a metallic axial member holding the magnet roller 13, and the magnet roller 13 is fixed to the magnet spindle 14 in a condition in which the plurality of magnetic poles are arrayed with a predetermined order in the circumferential direction (see FIG. 2). An end on the side of the front direction F of the magnet spindle 14 protrudes out of the center shaft 11, and a cut face 14*a* having a D-cut shape in section is formed at the protruding part.

The developing unit 4 includes the fixing conductive member 19 serving as a conductive member disposed on an outer end on the side of the front direction F of the developing container 41. The fixing conductive member 19 is made of a conductive resin and integrally includes a fixing hole (fixing portion) 19*a*, a bearing portion (supporting portion) 19*b* and a conductive portion 19*c*. In the present embodiment, the fixing conductive member 19 is formed of conductive polyacetal resin (volume resistivity of $1\times10^{2}\Omega\cdot$cm for example) by integral molding. Due to that, it is possible to realize high conductivity and high degree of freedom in shape at low cost. It is noted that although the present embodiment applies the resin having the volume resistivity of $1\times10^{2}\Omega\cdot$cm as the conductive resin constituting the fixing conductive member 19, the present disclosure is not limited to that. For instance, if the volume resistivity is $1\times10^{5}\Omega\cdot$cm or less, such resin is applicable as the conductive resin. As the conductive resin, the volume resistivity is preferable to be $1\times10^{1}\Omega\cdot$cm or more and $1\times10^{3}\Omega\cdot$cm or less. The volume resistivity is more preferable to be $1\times10^{2}\Omega\cdot$cm. Still further, the applied conductive resin is not limited to be the polyacetal resin, and other conductive resin such as conductive ABS resin is also applicable.

The fixing hole 19*a* of the fixing conductive member 19 is a through-hole that fixes the end on the side of the front direction F of the magnet spindle 14 and includes a abutment face 19*d* that abuts with the cut surface 14*a* of the magnet spindle 14. With the abutment of the cut face 14*a* and the abutment face 19*d*, the magnet spindle 14 is fixed non-rotationally with respect to the developing container 41 through the fixing conductive member 19. That is, the fixing hole 19*a* fixes the magnetic poles of the magnet roller 13 in the circumferential direction with respect to the developing container 41. The cut face 14*a* and the abutment face 19*d* are formed at circumferential position by which an orientation in the circumferential direction of the magnet spindle 14 is kept at an orientation set in advance and by which the magnetic poles of the magnet roller 13 are positioned at target positions. Thus, the magnetic poles of the magnet roller 13 are positioned and kept at the target positions by engaging the end on the side of the front direction F of the magnet spindle 14 with the fixing hole 19*a* of the fixing conductive member 19. As the fixing hole 19*a* contacts with the magnet spindle 14, the fixing conductive member 19 and the magnet spindle 14 are also electrically connected.

The bearing 19*b* of the fixing conductive member 19 also rotatably supports the ends on the side of the front direction F of the conveyance screws 43*a* and 43*b*. Because the conductive polyacetal resin is used as the fixing conductive member 19 in the present embodiment, slidability is enhanced more than other conductive resins, and the fixing conductive member 19 can function as the bearing of the conveyance screws 43*a* and 43*b*. This arrangement makes it possible to reduce a number of component parts and to cut the cost further. The bearing 19*b* is positioned between an abutment portion 19*e*, serving as a contacting part, that abuts and contacts with the contact portion 120, and the fixing hole 19*a*. Due to that, it is not necessary to expand the shape of the fixing conductive member 19 to outside of a range connecting the abutment portion 19*e* and the fixing hole 19*a* to form the bearing 19*b*, and size of the fixing conductive member 19 can be suppressed to small. The bearing 19*b* includes a seal (sealing member) 20 between the conveyance screw 43*a* to prevent the developer from leaking out.

The conductive portion 19*c* includes the abutment portion 19*e* that abuts with the contact portion 120 of the apparatus body 110 and a body portion 19*f* electrically conducting the contact portion 120 with the magnet spindle 14. The body portion 19*f* electrically conducts the abutment portion 19*e* with the fixing hole 19*a*. Here, disposed in a vicinity of the end on the side of the front direction F of the guide rail 111 is the contact portion 120 electrically connected with a high voltage power supply 118 through a developing high voltage substrate not illustrated. The contact portion 120 includes a contact terminal 121 and an urging spring (urging portion) 122. The contact terminal 121 is electrically connected with the high voltage power supply 118 and abuts with the abutment portion 19*e* of the fixing conductive member 19 when the developing unit 4 is attached to the apparatus body 110. The contact terminal 121 abuts with the fixing conductive member 19 toward the front direction F in the longitudinal direction X. The urging spring 122 is made of a compression spring for example and urges the contact terminal 121 toward the abutment portion 19*e* of the fixing conductive member 19, i.e., toward the front direction F of the longitudinal direction X.

Accordingly, the conductive portion 19*c* of the fixing conductive member 19 abuts with the contact portion 120 by the abutment portion 19*e* and electrically conducts the contact portion 120 with the magnet spindle 14 by the body portion 19*f*. Therefore, the high voltage power supply 118 is electrically connected with the developing sleeve 10 from the contact portion 120 through the fixing conductive member 19, the magnet spindle 14, the bearing 18 and the center shaft 11 and can apply the developing bias to the developing sleeve 10. The abutment portion 19*e* and the contact portion 120 are also formed so as to project under a moving locus of a bottom part of the developing container 41 such that they do not interfere with the developing container 41 in inserting/drawing the developing unit 4 into/out of the apparatus body 110. That is, the contact portion 120 is located outside of an outline of the developing container 41 in a view from the longitudinal direction X.

Because the conductive resin has large electric resistance and a low heat transfer coefficient as compared to metal, a heat quantity increases when a high voltage is applied as compared to applying power to metal. The temperature tends to increase at the abutment portion 19*e* in particular. Then, according to the present embodiment, the contact portion 120 is disposed within the ventiduct 115 to cool the contact portion 120 and the abutment portion 19*e* by air to suppress the temperature rise. The developing bias applied from the high voltage power supply 118 to the developing sleeve 10 is only DC voltage. This arrangement makes it possible to lower the generated heat further as compared to a case of applying AC voltage as the developing bias.

As described above, according to the image forming apparatus 100 of the present embodiment, the developing unit 4 includes the resin-made fixed conductive member 19 in which the fixing hole 19*a* and the conductive portion 19*c* are integrated. Due to that, the fixing hole 19*a* enables to fix the magnetic poles of the magnet roller 13 in the circumferential direction with respect to the developing container 41 and enables to electrically conduct the high voltage power supply 118 with the developing sleeve 10 from the contact portion 120 abutting with the abutment portion 19*e* through the fixing conductive member 19. Still further, because the fixing conductive member 19 is a resin-made integrated component, it is inexpensive and enables to reduce a number of component parts. Thus, it is possible to reduce the number of component parts while achieving the both of positioning of the magnetic poles of the magnet roller 13 and of feeding of power from the high voltage power supply 118 to the developing sleeve 10. As a result, it is possible to solve various problems otherwise caused by a large number of component parts such as a less degree of freedom of design caused by limited disposition of the parts, inferior assemblability and high cost. In particular, the present embodiment is more effective because the fixing conductive member 19 is formed by the integral molding.

Still further, because the coupling portion 119 is disposed on the side of the rear direction R of the apparatus body 110 in the image forming apparatus 100 of the present embodiment, the positioning of the magnetic poles of the magnet roller 13 and the electrical conduction of the developing bias need to be made on the side of the front direction F of the apparatus body 110. Then, the fixing conductive member 19 is provided on the side of the front direction F of the apparatus body 110 in the present embodiment to be able to make the positioning of the magnetic poles of the magnet roller 13 and the feeding of power from the high voltage power supply 118 to the developing sleeve 10 without interfering with the coupling portion 119.

Still further, the contact portion 120 abuts with the fixing conductive member 19 in the front direction F in the image forming apparatus 100 of the present embodiment. Due to that, the abutment portion 19*e* moves to the rear direction R side and abuts with and presses the contact portion 120 against the urging force of the urging spring 122 with the inserting operation of the developing unit 4, good operability can be obtained without specific operation of contacting the contact portion 120 with the fixing conductive member 19.

Still further, the bearing 19*b* rotatably supporting the conveyance screws 43*a* and 43*b* is integrated with the fixing conductive member 19 in the image forming apparatus 100 of the present embodiment. Because the conductive polyacetal resin is used as the fixing conductive member 19, the fixing conductive member 19 has high slidability and functions well as the bearing of the conveyance screws 43*a* and 43*b*. This configuration also makes it possible to reduce the number of component parts and to cut the cost further.

Only the DC voltage is used as the developing bias in the image forming apparatus 100 of the present embodiment. This arrangement makes it possible to lower the generated heat further as compared to a case of applying AC voltage as the developing bias. Still further, although there is a possibility that a corner of a rectangular wave becomes dull in a case of applying AC voltage of the rectangular wave depending on a magnitude of the volume resistivity of the fixing conductive member 19, it is possible to avoid such possibility because only the DC voltage is used in the present embodiment. Note that although only the DC voltage is used as the developing bias in the present embodiment, the present disclosure is not limited to that. That is, the developing bias may be only AC current or may be what AC voltage is superimposed on DC voltage.

Still further, the contact portion 120 is disposed within the ventiduct 115 in the image forming apparatus 100 of the present embodiment. This arrangement makes it possible to cool the contact portion 120 and the abutment portion 19*e* by air and to suppress their temperature from rising.

Second Embodiment

Next, a second embodiment of the present disclosure will be described in detail with reference to FIG. 10. In the present embodiment, no dedicated contact portion 120 is provided and the pressing mechanism 30 is applied as a contact portion. That is, the present embodiment is different from the configuration of the first embodiment in that the developing bias is fed from the pressing mechanism 30 to the fixing conductive member 19. However, the configuration other than that is the same with the first embodiment, so that the same component parts of the present embodiment will be denoted by the same reference numerals and their detailed description will be omitted here.

Figure 10:
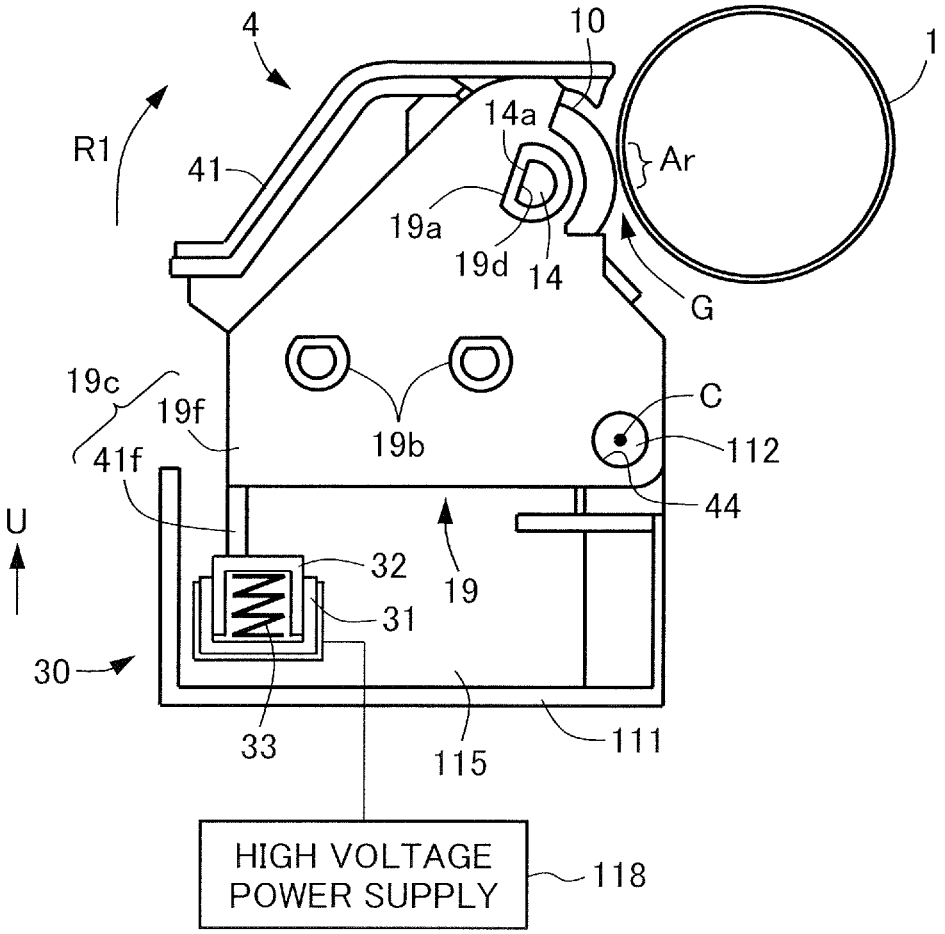
FIG. 10 is a section view of the developing unit and the guide rail of a second embodiment.

In the present embodiment, the fixing conductive member 19 is made of a conductive resin and integrally includes the fixing hole 19*a*, the bearing 19*b* and the conductive portion 19*c* as illustrated in FIG. 10. The conductive portion 19*c* includes the supporting portion (abutment portion) 41*f* abutting with the pressing member 32 of the apparatus body 110 and the body portion 19*f* that electrically conducts the pressing member 32 with the magnet spindle 14. The body portion 19*f* electrically conducts the supporting portion 41*f* with the fixing hole 19*a*.

Still further, the operating member 31 of the pressing mechanism 30 is electrically connected with the high voltage power supply 118. After attaching the developing unit 4, the developing bias is applied from a developing high voltage substrate not illustrated to the operating member 31 through a bundle wire and applied to the supporting portion 41*f* through the urging spring 33 and the pressing member 32 in applying the developing bias from the high voltage power supply 118. That is, the pressing mechanism 30 serving as a contact portion includes the pressing member 32 serving as a contact terminal and the urging spring 33 serving as an urging portion. The pressing member 32 is electrically connected with the high voltage power supply 118 and abuts with the supporting portion 41*f* of the fixing conductive member 19 in a case where the developing unit 4 is attached to the apparatus body 110. The urging spring 33 urges the pressing member 32 toward the supporting portion 41*f* of the fixing conductive member 19. Note that although the pressing mechanisms 30 are provided in correspondence to the both end portions in the longitudinal direction X of the developing unit 4 also in the present embodiment, the developing bias is applied only from the pressing mechanism 30 on the side of the front direction F.

The pressing member 32 abuts with the supporting portion 41*f* of the fixing conductive member 19 in the upper direction U, i.e., the cross direction crossing with the longitudinal direction X, also in the present embodiment. The urging spring 33 urges the pressing member 32 in the upper direction U and also urges the developing unit 4 toward the photosensitive drum 1 through the fixing conductive member 19. Therefore, the developing unit 4 is urged in the rotational direction R1 centering on the center line C.

In the present embodiment, the conductive polyacetal resin (volume resistivity of $1\times10^2\Omega\cdot$cm) is used as the material of the fixing conductive member 19 and the pressing member 32. Because this arrangement makes it possible to commonly use the urging spring 33 for pressing the developing unit 4 toward the drum cartridge 50 also as the urging spring for use as the contact portion feeding the developing bias to the fixing conductive member 19, the cost can be cut further.

As described above, the developing unit 4 includes the fixing conductive member 19 made of the resin and integrated with the fixing hole 19*a* and the conductive portion 19*c* in the same manner with the first embodiment also in the image forming apparatus of the present embodiment 100. Thus, it is possible to reduce a number of component parts while achieving the both of positioning of the magnetic poles of the magnet roller 13 and of feeding of power from the high voltage power supply 118 to the developing sleeve 10. As a result, it is possible to solve various problems otherwise caused by a large number of component parts such as a less degree of freedom of design caused by limited disposition of the parts, inferior assemblability and high cost. In particular, because the present embodiment enables to commonly use the urging spring 33 for pressing the developing unit 4 toward the drum cartridge 50 also as the urging spring for use as the contact for feeding the developing bias to the fixing conductive member 19, the cost can be cut further.

Other Embodiment

While the case where the resin-made fixed conductive member 19 is formed by integral molding has been described in each embodiment described above, the present disclosure is not limited to that and a plurality of resin members may be integrated by bonding or welding for example. Still further, while the case where the fixing conductive member 19 serving as a conductive member integrally includes the fixing hole 19*a*, the bearing 19*b* and the conductive portion 19*c* has been described in each embodiment described above, the present disclosure is not limited to that. The fixing conductive member may be what includes a fixing portion fixing the magnetic poles of the magnet roller 13 in the circumferential direction with respect to the developing container 41, is made of a conductive resin and abuts with the contact portion to electrically conduct the contact portion with the developing sleeve 10.

Still further, the configuration which presses the developing unit 4 toward the photosensitive drum 1 in the rotational direction R1 centering on the center line C has been described in each embodiment described above, the present disclosure is not limited to such configuration. For instance, it is also possible to adopt a configuration that presses the developing unit 4 toward the photosensitive drum 1 by sliding in a linear manner.

Figure 11:
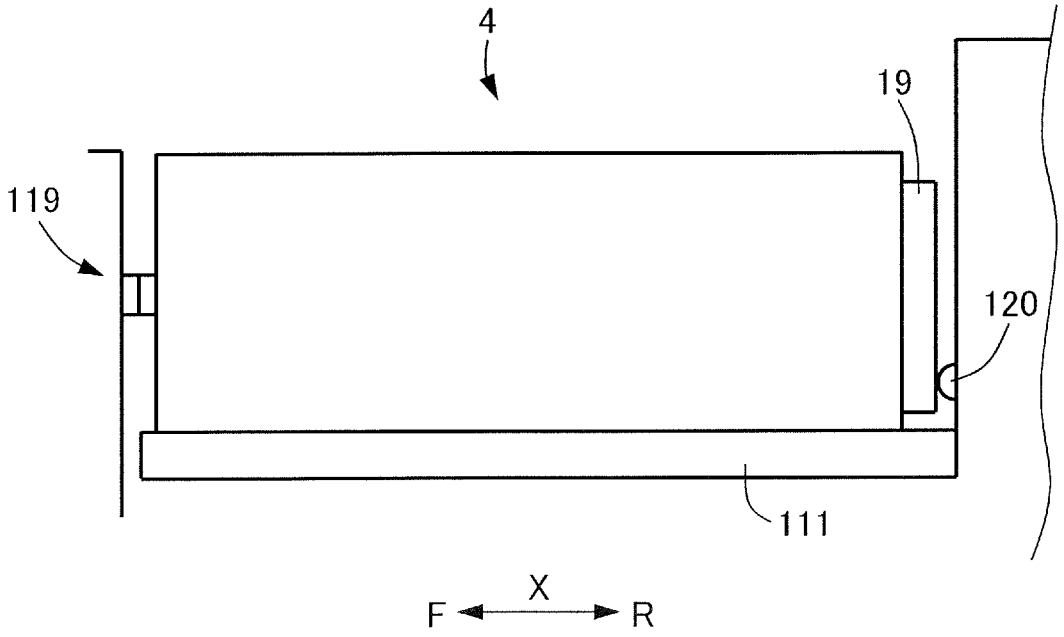
FIG. 11 is a side elevation of the developing unit and the guide rail of the other embodiment.

While the case where the coupling portion 119 is provided on the side of the rear direction R of the apparatus body 110 and the contact portion 120 (or the pressing mechanism 30) is provided on the side of the front direction F of the apparatus body 110 has been described in each embodiment described above, the present disclosure is not limited to such case. Inversely, as illustrated in FIG. 11, the coupling portion 119 may be provided on the side of the front direction F of the apparatus body 110 and the contact portion 120 (or the pressing mechanism 30) may be provided on the side of the rear direction R of the apparatus body 110.

While the case where the developing unit 4 and the drum cartridge 50 can be respectively attached separately and removably to the apparatus body 110 has been described in each embodiment described above, the present disclosure is not limited to such case. For instance, it is also possible to configure such that the developing unit 4 and the drum cartridge 50 are detached, in a condition of being integrated, out of the apparatus body 110 and to separate the developing unit 4 from the drum cartridge 50 on the outside of the apparatus body 110.

While the case of using the printer as the image forming apparatus 100 has been described in each embodiment described above, the present disclosure is applicable also to an image forming apparatus such as a copier, a facsimile machine and a multi-function printer other than the printer.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-052363, filed Mar. 20, 2018 which is hereby incorporated by reference herein in its entirety.

What is claimed is:

1. An image forming apparatus, comprising:

an image bearing member;

a developing unit configured to develop an electrostatic image formed on the image bearing member, the developing unit being able to attach to the image forming apparatus, the developing unit comprising (a) a developing container configured to accommodate developer, (b) a developer bearing member configured to rotate while bearing the developer accommodated in the developing container, and (c) a developing magnet provided within the developer bearing member, the developing magnet including a plurality of magnetic poles in a rotational direction of the developer bearing member;

a power supply configured to apply a developing bias to the developer bearing member; and a contact portion electrically connected with the power supply, wherein the developing unit comprises a conductive member which is made of a conductive resin, the conductive member including integrally a fixing portion, the fixing portion fixing the developing magnet so that the plurality of magnetic poles of the developing magnet is fixed unrotatably with respect to the developing container, the conductive member being provided to electrically connect the contact portion with the developer bearing member.

2. The image forming apparatus according to claim 1, wherein the developing unit includes (1) a conductive supporting shaft for supporting the developing magnet while fixing the developing magnet unrotatably and (2) a conductive bearing for supporting the developer bearing member with respect to the supporting shaft rotatably, and wherein the conductive member abuts with the contact portion and the fixing portion fixes the supporting shaft unrotatably while contacting with the supporting shaft.

3. The image forming apparatus according to claim 1 further comprising:

a driving source configured to rotationally drive the developer bearing member; and a coupling portion configured to couple the developer bearing member with the driving source, wherein the developing unit is configured to be attached to the image forming apparatus by inserting in a rotational axial direction of the developer bearing member, wherein the contact portion is disposed in a vicinity of one side end of the developing unit in the rotational axial direction, and wherein the coupling portion is disposed in a vicinity of another side end of the developing unit in the rotational axial direction.

4. The image forming apparatus according to claim 3, wherein the one side end is an upstream side end in an insert direction in which the developing unit is inserted into the image forming apparatus, and wherein the another side end is a downstream side end in the insert direction.

5. The image forming apparatus according to claim 4, wherein the contact portion is located outside of an outline of the developing container when viewed in the rotational axial direction.

6. The image forming apparatus according to claim 3, wherein the another side end is an upstream side end in an insert direction in which the developing unit is inserted into the image forming apparatus, and wherein the one side end is a downstream side end in the insert direction.

7. The image forming apparatus according to claim 1, wherein the contact portion includes (1) a contact terminal being electrically connected with the power supply and (2) an urging portion configured to urge the contact terminal toward the conductive member, the contact terminal being configured to abut with the conductive member in a state that the developing unit is attached to the image forming apparatus.

8. The image forming apparatus according to claim 7, wherein the urging portion is configured to cause the contact terminal to abut with the conductive member by urging the contact terminal in the rotational axial direction of the developer bearing member.

9. The image forming apparatus according to claim 8, wherein the urging portion is configured to cause the contact terminal to abut with the conductive member by urging the contact terminal in a direction opposite to an insert direction in which the developing unit is inserted into the image forming apparatus.

10. The image forming apparatus according to claim 7, wherein the contact terminal is configured to abut with the conductive member in a cross direction crossing with a rotational axial direction of the developer bearing member, and wherein the urging portion is configured to urge the contact terminal in the cross direction and urge the developing unit toward the image bearing member through the conductive member.

11. The image forming apparatus according to claim 1, wherein the image forming apparatus comprises an attachment portion to which the developing unit is attached, and wherein the attachment portion comprises a ventiduct formed between the attachment portion and the developing unit, air flowing through the ventiduct along the rotational axial direction of the developer bearing member.

12. The image forming apparatus according to claim 11, wherein the contact portion is disposed within the ventiduct.

13. The image forming apparatus according to claim 1, wherein the developing bias applied from the power supply to the developer bearing member is only DC voltage.

14. The image forming apparatus according to claim 1, wherein the conductive member has volume resistivity of $1\times10^5\Omega\cdot$cm or less.

15. The image forming apparatus according to claim 1, further comprising:

an agitating member configured to agitate the developer accommodated in the developing container, wherein the conductive member includes a supporting portion integrally, the supporting portion rotatably supporting the agitating member.

16. The image forming apparatus according to claim 15, wherein the conductive member is made of a conductive polyacetal resin.

17. The image forming apparatus according to claim 15, wherein the supporting portion is located between the fixing portion and a contacting part contacting with the contact portion.

18. The image forming apparatus according to claim 15, wherein the developing unit comprises a sealing member configured to seal a space between the supporting portion and the agitating member.

19. The image forming apparatus according to claim 1, wherein the developer bearing member is rotatably supported by the developing container.

20. The image forming apparatus according to claim 1, wherein the developing container is made of an insulating resin.

* * * * *